United States Patent [19]

Mayr et al.

[11] 3,970,314

[45] July 20, 1976

[54] INTERENGAGING RINGS PUZZLE

[75] Inventors: Gert Michael Mayr, Graz; Wolfgang Schöfl, Linz, both of Austria

[73] Assignee: Hermann Hansmann, Vienna, Austria

[22] Filed: Feb. 24, 1975

[21] Appl. No.: 552,128

[30] Foreign Application Priority Data

Feb. 25, 1974 Austria ..... 1490/74

[52] U.S. Cl. ..... 273/156; 273/160

[51] Int. Cl.[2] ..... A63F 9/12

[58] Field of Search..... 273/156, 157, 158, 153 R, 273/160; 46/25

[56] References Cited

UNITED STATES PATENTS

| | | | |
|---|---|---|---|
| 1,050,141 | 1/1913 | Joy | 273/156 |
| 1,095,908 | 5/1914 | Messenger | 273/158 |
| 1,338,973 | 5/1920 | Brown | 273/158 |
| 1,972,128 | 9/1934 | Bobbroff | 273/158 |
| 2,241,490 | 5/1941 | Steinhardt | 273/160 |
| 3,340,781 | 9/1967 | See | 46/25 |

*Primary Examiner*—Anton O. Oechsle
*Attorney, Agent, or Firm*—Karl F. Ross; Herbert Dubno

[57] ABSTRACT

A plurality of rings of identical width and diameter, having a rectangular cross-section, include one solid ring and several split rings adapted to be assembled into a coplanar array. Each split ring is provided on each of its opposite faces with one or more generally radial grooves, each matingly engageable with a similar groove on one of the other rings, and also has a throughgoing slot accommodating the solid ring, the latter having a face formed with a groove for each of the remaining rings.

5 Claims, 3 Drawing Figures

INTERENGAGING RINGS PUZZLE

This invention relates to a puzzle which consists of a plurality of rings of rectangular cross-section which are in diameter and in width and are formed on their top and/or bottom end faces with grooves which are wider than the rings so that the latter can be fitted together to form a plane figure.

The known puzzles of this kind have the disadvantage that the rings can be fitted together only by placing one ring on the other. For this reason, the composite plane figure has only a relatively low stability and easily disintegrates into the several rings when the figure is grasped.

It is an object of the invention to eliminate the above-mentioned disadvantabge and to provide a puzzle of the aforestated kind which permits the compositie figure to be grasped without fear of its disintegration into individual parts. We realize this object, in accordance with our present invention, by providing a solid ring and one or more split rings each having a peripheral slot accommodating the solid ring, the latter having a generally radial groove for each split ring. Each face of each split ring is provided with one or more similar grooves enabling oppositely facing grooves of different rings to be assembled into an interfitting coplanar array with the solid ring passing through the slot of each split ring.

A particularly desirable embodiment of our invention comprises five rings, four of which have each a continuous slot whereas the fifth rings is inserted into all four slots in the composite figure.

The accompanying drawing shows by way of example an embodiment of the invention. In the drawing.

Figure 1:
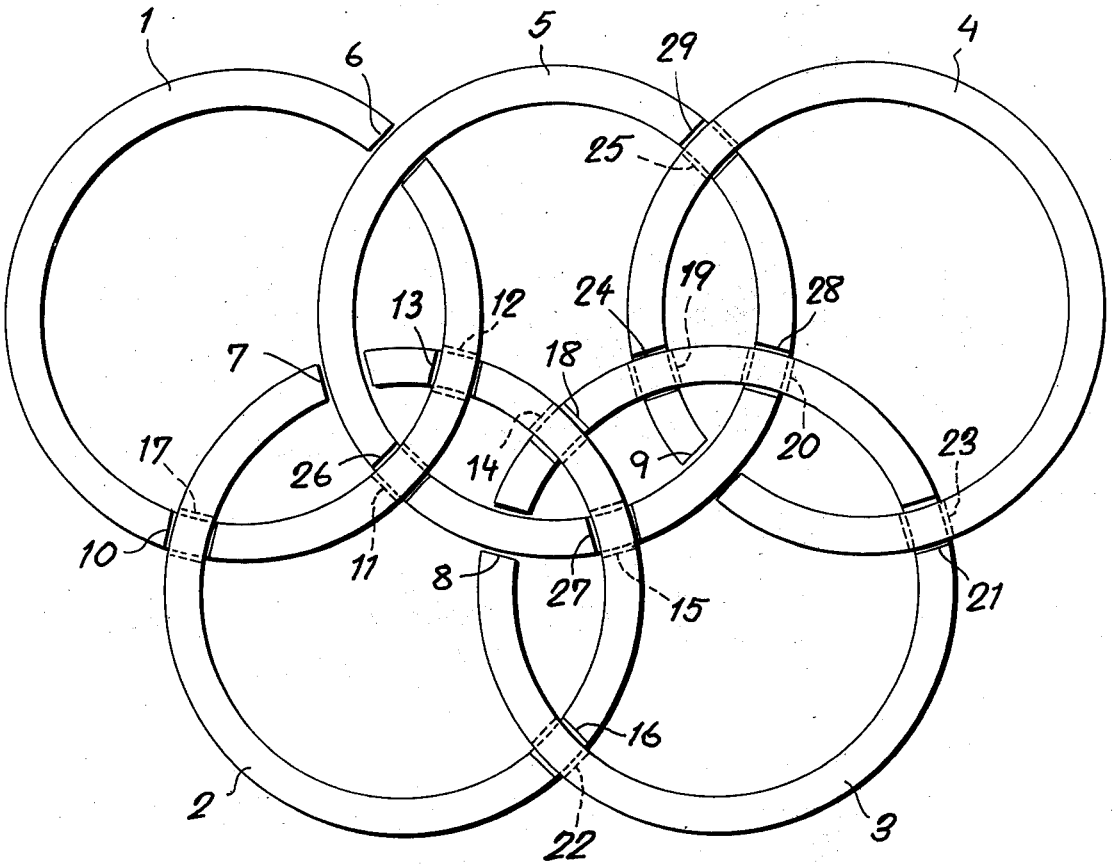
FIG. 1 shows the composite puzzle.
Figure 3:
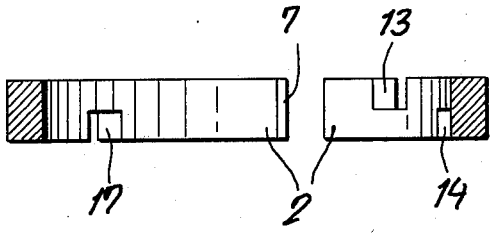
FIG. 3 is a sectional view taken on line III—III in FIG. 2.

The puzzle shown in the drawing comprises five rings 1, 2, 3, 4, 5 which are provided with grooves 10–29. Some of these grooves, namely the grooves 10, 13, 16, 18, 21, 24, 26, 27, 28, 29, are formed in the top surfaces of the rings 1–5. The remaining grooves 11, 12, 14, 15, 17, 19, 20, 22, 23, 25 are formed in the bottom surfaces. Each of the split rings 1, 2, 3, 4, is formed at one point with a throughgoing slot 6, 7, 8 or 9, which permits these rings to be interlinked. The solid ring 5 is the locking ring. The grooves 10–29 and the slots 6-9 extend substantially radially and are slightly wider than the rings 1–5.

Figure 2:
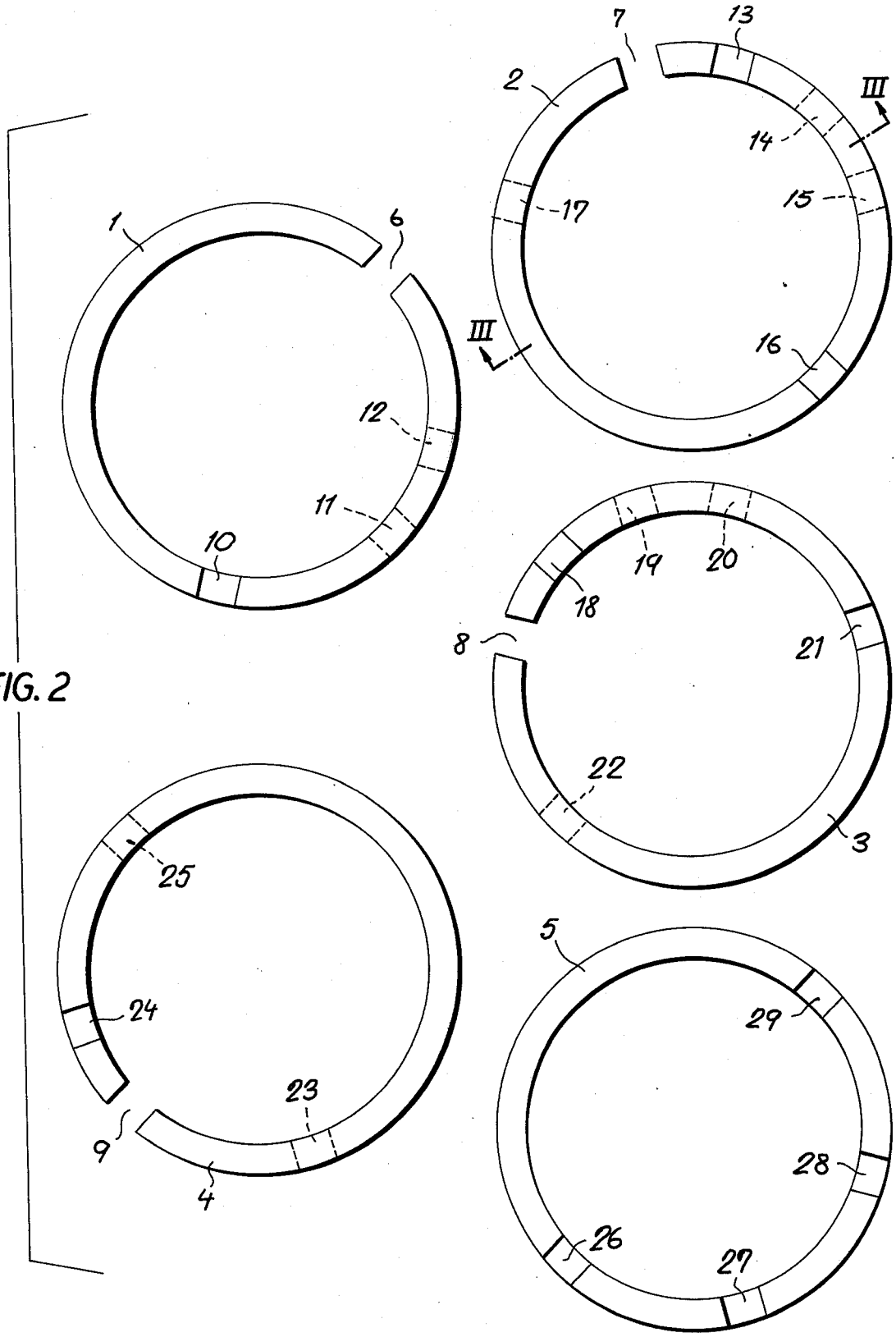
FIG. 2 shows the separate rings of the puzzle.

Before the rings are fitted together, they are first placed on a support in the manner shown in FIG. 2. The ring 2 is then interlinked with the ring 1, e.g., in that the ring 1 is pushed through the slot 7 of the ring 2. The rings 1 and 2 are then rotated relative to each other until the groove 17 is disposed over the groove 10 and the groove 12 is disposed over the groove 13. The rings 1 and 2 are then moved toward each other until they interengage at the grooves 17 and 10 and at the grooves 12 and 13 so that the rings lie in a plane.

The rings 2 and 3 are similarly connected in that the groove 22 is moved to a position over the groove 16 and the groove 14 to a position over the groove 18 after both rings have been interlinked. Thereafter, the two rings 3 and 4 are interlinnked and are then moved so that the groove 23 is disposed over the groove 21 and the groove 21 and the groove 19 is disposed over the groove 24. Finally the locking ring 5 is fitted into the rings 1–4, which are interlinked and which interlock at the grooves, 10,17; 12,13; 14,18; 16,22; 19,24; 21,23. For this purpose, the groove 11 is moved to a position over the groove 26, the groove 15 to a position over the groove 27, the groove 20 to a position over the groove 28 and the groove 25 to a position over the groove 29. The throughgoing slots 6–9 of the rings 1–4 are occupied by the ring 5, which is not weakened in its cross-section at these points.

Whereas each of the split rings 1 – 4 has at least one groove on each of its opposite faces, the solid ring 5 has all its grooves 26 – 29 on only one face to facilitate its assembly with the rings 1 – 4 already interlinked into a chain.

What is claimed is:

1. A puzzle comprising a plurality of rings of like width and diameter with substantially flat opposite faces, one of said rings being solid, each remaining ring being split by a peripheral slot accommodating said solid ring, each split ring being provided on each of said faces with at least one generally radial groove, said solid ring being provided with a generally radial groove for each split ring, oppositely facing grooves of different rings being interengageable for enabling assembly of said rings into an interfitting coplanar array with said solid ring passing through the slot of each split ring.

2. A puzzle as defined in claim 1 wherein said rings have rectangular cross-sections.

3. A puzzle as defined in claim 1 wherein the number of said rings is at least three, the grooves of said solid ring being all provided on the same face thereof.

4. A puzzle as defined in claim 1 wherein the number of split rings is four.

5. A puzzle as defined in claim 4 wherein two of said split rings have three grooves each and the remaining two split rings have four grooves each.

* * * * *